United States Patent [19]

Yanobu et al.

[11] 4,355,500

[45] Oct. 26, 1982

[54] PNEUMATIC YARN GUIDING APPARATUS FOR DOUBLE TWISTING MACHINE

[75] Inventors: Hideo Yanobu; Kazuyuki Fujiwara, both of Kyoto, Japan

[73] Assignee: Murata Kikai Kabushiki Kaisha, Kyoto, Japan

[21] Appl. No.: 113,645

[22] Filed: Jan. 21, 1980

[30] Foreign Application Priority Data

Jul. 23, 1979 [JP] Japan ..... 54-102232[U]
Jul. 25, 1979 [JP] Japan ..... 54-103255[U]
Jul. 27, 1979 [JP] Japan ..... 54-96431

[51] Int. Cl.[3] ..... D01H 15/00; D01H 7/86

[52] U.S. Cl. ..... 57/279; 57/58.7; 57/58.86

[58] Field of Search ..... 57/58.49, 58.87, 58.86, 57/58.7, 279, 280

[56] References Cited

U.S. PATENT DOCUMENTS 2,715,308 8/1955 Soussloff et al. ..... 57/279 X
3,429,113 2/1969 Nimitz et al. ..... 57/279 X
3,731,478 5/1973 Franzen ..... 57/58.7
3,830,051 8/1974 Veltges ..... 57/58.83
3,945,184 3/1976 Franzen ..... 57/279 X
4,047,372 9/1977 Horstmann et al. ..... 57/279
4,168,605 9/1979 D'Agnolo ..... 57/279
4,199,929 4/1980 Vessella ..... 57/279
4,287,712 9/1981 Franzen ..... 57/279

*Primary Examiner*—John Petrakes
*Attorney, Agent, or Firm*—Moonray Kojima

[57] ABSTRACT

A pneumatic yarn guiding apparatus for a double twisting machine, two-for-one twister. A yarn passage of the double twisting machine is formed by a yarn guide tube vertically movable inserted in the tension device mounted in the center of a yarn supply bobbin, a yarn guide hole formed in the center of a stationary disc through the center of the spindle, a yarn guide tube formed in the radial direction of a yarn store disc, a yarn passing space formed between a rotary disc secured to the spindle and an outer ring, and a vertical space between the outer cylinder of the stationary disc and balloon restricting cylinder.

6 Claims, 9 Drawing Figures

FIG. 3-A
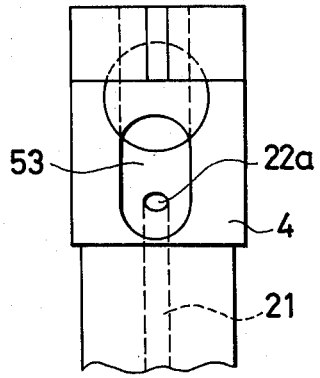
FIG. 3-B
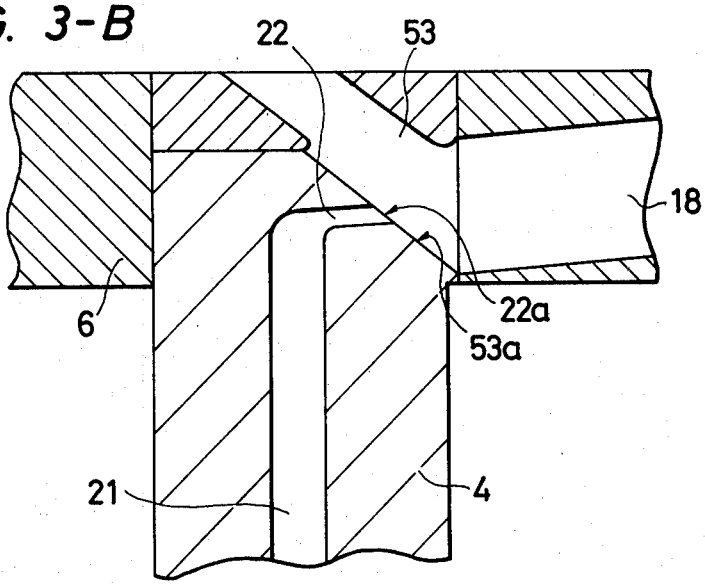

PNEUMATIC YARN GUIDING APPARATUS FOR DOUBLE TWISTING MACHINE

BACKGROUND OF THE INVENTION

In a double twisting machine, two-for-one twister, it is conventionally known that a yarn is processed by taking out from a yarn supply bobbin, inserting in a flyer, passing through a hollow shaft, a tension applying device or yarn braking device which is mounted in the shaft of the hollow spindle to controlling the tension of the ballooning, and a rotating portion of the spindle at the lower end thereof, and then drawing up to a feed roller arranged at the upper place of the double twisting machine. When the yarn breakage is occurred or the yarn supply bobbin is changed, the yarn guiding operation into the double twisting machine may be performed by utilizing a sucking action caused by jetting an air stream. However, the yarn guiding operation cannot be performed smoothly because the tension applying device is provided in the yarn passage and the inserted yarn has to be bent and drawn up to the feed roller positioned above the double twisting machine.

SUMMARY OF THE INVENTION

The present invention relates to a pneumatic yarn guiding apparatus in a double twisting machine, two-for-one twister. An object of the present invention is to provide a pneumatic yarn guiding apparatus in a double twisting machine, in which compressed air can be immediately supplied to a compressed air guide hole opened at one position of a yarn passage irrespectively of the stop position of a rotary spindle and the yarn guiding operation can thus be performed. It is another object of the present invention to provide such pneumatic yarn guiding apparatus in which leakage of supplied compressed air from the air jet hole is completely prevented and compressed air is smoothly supplied to an air guide hole. Still another object of the present invention is to provide a pneumatic yarn guiding apparatus in which an air guide hole and an air jet hole are arranged so that the processing operation can be facilitated. Further object of the present invention is to provide a pneumatic yarn guiding apparatus in which a compressed air jet opening is formed and arranged so that the sucking force caused by an air stream jetted from a jet hole is effectively propagated to a yarn end supply zone to enhance the yarn sucking effect.

Further more object of the present invention is to provide a pneumatic yarn guiding apparatus in which a tension applying device of the double twisting machine is displaced from the center of an opening of a yarn contact guide member when the yarn guiding operation is proceeded. It is indispensable that a tension applying device should be built in a double twisting machine, and if the pneumatic yarn passing operation is carried out in the double twisting machine, an air stream passage is formed and a sucking action should be caused in a yarn guide hole by a jetted air stream. However, since the air stream passage is shut in the tension applying apparatus comprising a tensor and a yarn contact guide, the sucking action is not caused in this portion. Accordingly, an air stream passage must be formed by displacing the tensor from the center of the opening of the yarn contact guide so that the yarn passing operation can be performed smoothly.

BRIEF DESCRIPTION OF DRAWINGS

FIG. 3-A is an enlarged view showing the connecting portion of a spindle and a yarn store disc;

FIG. 3-B is an enlarged front view in section showing the connecting portion of a spindle and a yarn store disc;

DETAILED DESCRIPTION OF THE INVENTION

The present invention will now be described in detail with reference to embodiments illustrated in the accompanying drawings.

Figure 1:
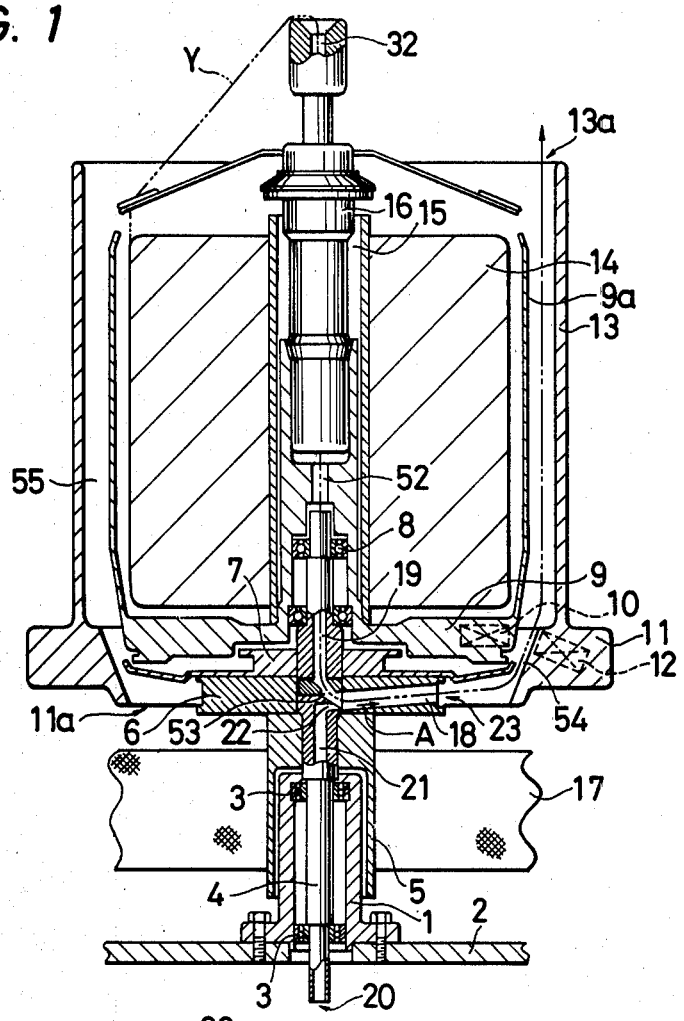
FIG. 1 is a longitudinally sectional view of the double twisting machine of the present invention.

Referring to FIG. 1, a supporting tube 1 is fixed to a frame 2 and a spindle 4 is rotatably supported on the supporting tube 1 through a bearing 3. A wharve 5, a yarn store disc 6 and a rotary disc 7 are integrally fixed to the spindle 4.

A stationary disc 9 is supported on the spindle 4 through a bearing 8, and the stationary disc 9 is immovably fixed by the magnetic actions of a magnet 10 built in the stationary disc 9 and a magnet 12 built in an outer ring 11 having an upwardly expanded inclined surface.

It is preferred that no slit be formed on the outer ring 11 and that the lower end face 11*a* of the outer ring 11 be located below the opening of a yarn guide tube 18 described hereinafter.

An outer balloon restricting cylinder 13 and this outer ring 11 are fixed to the frame 2. A yarn supply bobbin 14 is placed on the stationary disc 9 and a tension device 16, described hereinafter, is fitted to a central cylinder 15 of the stationary disc 9. A running belt 15 is disposed to fall in contact with wharve 5 and rotate the spindle 4.

A yarn guide tube 18 is disposed in the yarn store disc 6 to extend in the radial direction thereof, and the yarn guide tube 18 is communicated with a yarn guide hole 19 formed through the center of the spindle 4, through an inclined hole 53.

An air guide hole 21 having an opening 20 on the lower end is formed through the center of the spindle, and as shown in FIGS. 1 and 3-B, a jet hole 22 of the air guide hole 21 is opened at 22*a* on an inclined face 53*a* of an inclined hole 53 formed in the connection portion between the yarn guide hole 19 of the spindle 4 and the yarn guide tube 18 mounted on the yarn store disc 6. The jet hole 22 of the air guide hole 21 is arranged so that air is jetted toward an outlet 23 of the yarn guide tube 18. More specifically, referring to FIG. 3-B, the vertical air guide hole 21 formed in the spindle 4 has the top end communicated with the lateral air jet hole 22 extended in the axial direction of the yarn guide tube 18, and the opening 22*a* of the air jet hole 22 is formed on the lower inclined face of the inclined hole 53.

The reason why the inclined hole 53 is formed as the communication portion between the yarn guide hole 19 of the spindle 4 and the yarn guide tube 18 is that the flow of the yarn introduced from the upper portion of the spindle can be smoothened. More specifically, in this case, advance of the yarn by the sucking force is performed more smoothly than in the case where the communication portion is bent at a right angle. Accordingly, only the opening 22*a* of the air jet hole 22 is formed on the inclined face 53*a* and any projection for formation of the opening 22*a* is not present on the inclined face 53*a*.

In the pneumatic yarn guiding apparatus, it is necessary that no flow running upwardly in the yarn guide hole 19 should be formed in streams of jetted air. From this viewpoint, the jet hole 22 is formed at a right angle to the vertical axis of the yarn guide hole 19 or in parallel to the inclination of the bottom face of the yarnguide tube 18, whereby there is attained a feature that the upward component of the force of jetted air is not formed and air stream flows in the radial direction.

Accordingly, the opening 22*a* is located on the inclined face 53*a* near the center thereof, preferably in the vicinity of the yarn guide hole 19, so that a strong stream of jetted air acts on the yarn at the early stage of 90° deflection of the yarn and the yarn is caused to move outwardly from the yarn guide tube 18. Therefore, a disadvantage that the yarn becomes stagnant in the vicinity of the inclined hole 53 because of an insufficient quantity of air in the initial stage of the yarn passing operation is eliminated.

Figure 2:
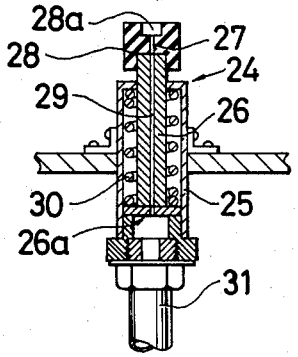
FIG. 2 is a longitudinally sectional view of the compressed air supplying device.

A compressed air supply valve 24 for supplying compressed air to the air guide hole 21 of the spindle 21 is disposed below the spindle as shown in FIG. 2. This valve 24 includes a compressed air supply fine tube 27 opened just below the air guide hole 21 opened to the lower end of the spindle 4 on the axial line of the spindle 4. A cylinder 25 coaxial with the spindle 4 is fixed onto the frame 2, and a piston 26 is inserted in the cylinder 25 so that the piston 26 can slide in the vertical direction along the inner wall of the cylinder 25. The top end of the piston 26 is located outwardly of the cylinder 25 and a joint 28 having a compressed air supply fine tube 27 composed of an elastic member such as rubber is fitted to the top end of the piston 26. A spring 30 is wound on the periphery of the piston 26 and an air guide hole 29 is formed through the center of the piston 26 in the cylinder 25. The piston 26 is downwardly urged by the spring 30.

A compressed air supply tube 31 is screwed in a compressed air supply hole on the lower face of the cylinder 25.

When compressed air is supplied in the cylinder 25 from the compressed air supply tube 31, compressed air acts on the lower face 26*a* of the piston 26, and the piston 26 is caused to rise against the spring 30 and the recess 28*a* of the joint 28 on the top end of the piston 26 is pressed and fitted in the lower end of the spindle 4. Thus, compressed air is supplied to the air guide hole 21 of the spindle 4 through the air guide hole 29 of the piston and the air guide hole 27 of the joint 28.

Since the center of the spindle 4 and the center of the piston 29 are on the same axial line, the air guide hole 21 is communicated with the air guide hole 29 irrespectively of the stop position of the spindle 4.

The valve 24 is arranged so that when a pedal (not shown) is depressed at the time of occurrence of a yarn breakage or at the time of yarn exchange, the running belt 17 is separated from the wharve 5 and simultaneously, the spindle is stopped by braking and a valve changeover switch is put on to allow compressed air to flow in the compressed air supply tube 31.

The tension device 16 inserted into the central portion of the yarn supply bobbin 14 will now be described with reference to FIGS. 4 to 8.

In a first embodiment of the tension device 16, a lower housing 33 has a supporting portion 34 acting as a supporting member when the device 16 is inserted in the yarn supply bobbin 14 and the lower housing 33 is dismountably fixed to an upper housing 36 through a screw 35.

A yarn guide tube 38 having a guide face 37 formed by cutting off obliquely the lower end of the guide tube 38 is inserted in the central hole of the upper housing 36, and a collar 40 including a flange 39 is fixed to the yarn guide tube 38 in the interior of the housing 36. A spring 42 is wound between the flange 39 of the collar 40 and a fixed ring 41 in the interior of the housing 36, and the yarn guide tube 38 is normally urged upwardly by the spring 42 and maintained at a position indicated by a solid line by the collar 40.

A nut 48 having a central hole 47, which is constructed integrally with a supporting member 46 of a ball tensor 45 having a frustoconical face 44 having a yarn guide hole 43 formed at the center thereof, is screwed in the lower housing 33 to support the supporting member 46 of the ball 45. Member 46 and hole 43 comprise a yarn contact guide.

A flyer boss 49 is inserted in the yarn guide tube 38 and placed on the upper housing 36, and a yarn guide 50 is screwed to the top end of the yarn guide tube 38. The numeral 51 indicates a yarn guide hole of the yarn guide tube 38.

Accordingly, in the normal operation, the ball tensor 45 is located on the central hole 43 of the supporting member 46, and the yarn travels from the yarn guide 50, passes through the interior of the yarn guide tube 38 and reaches the yarn guide hole 19 of the spindle 4 located below through between the ball tensor 45 and the ball supporting member 46, whereby the yarn is gripped between the ball tensor 45 and the supporting member 46 and a tension is given to the yarn.

The operation of the yarn passing apparatus having the above-mentioned structure for a double twisting machine will now be described.

At the time of yarn breakage or yarn exchange, rotation of the spindle is stopped by known means, and when the valve changeover switch (not shown) is put on, compressed air is allowed to flow in the compressed air supply tube 31 and compressed air introduced into the cylinder 25 raises up the piston 26 against the spring 30. Since at this point, the piston 26 is located just below the center of the spindle and the piston 26 makes only a rising movement, the joint 28 on the top end of the piston is fitted in the spindle 4, and the air guide holes 29, 27 and 21 of the piston 26, joint 28 and spindle 4 are communicated with one another and compressed air supplied from the supply tube 31 flows into the air guide hole 21 of the spindle and compressed air is jetted in the yarn guide tube 18 formed on the yarn store disc 6 from the jet hole 22 on the top end of the air guide hole 21.

Figure 4:
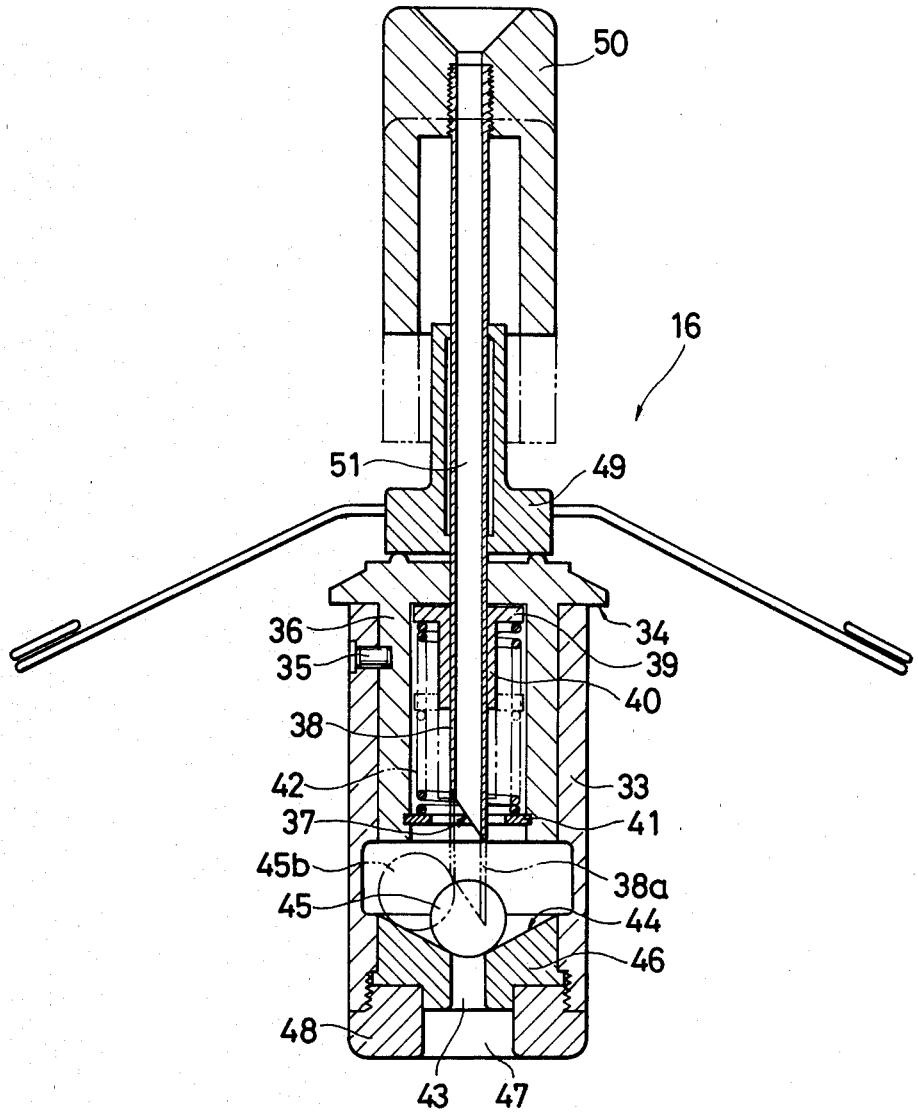
FIG. 4 is a longitudinally sectional view of showing one embodiment of a tension device.

In the above-mentioned state, when the yarn guide 50 and the yarn guide tube 38 shown in FIG. 4 are manually pushed down against the spring 42 and the lower end of the yarn guide tube 38 is brought down to a position 38*a* indicated by a chain line, the ball 45 is outwardly pushed by the inclined guide face 37 formed on the lower end of the yarn guide tube 38 and is fixed at this chain line position 38*a*, whereby the yarn guide hole 51 of the yarn guide tube 38 is communicated with the central hole 43 of the ball supporting member 46. Incidentally, if the lower end of the yarn guide tube 38 is brought down to the position where this lower end intrudes into the central hole 43 of the ball supporting member 46, the sucking force by the sucked air stream is assuredly transmitted to the top end of the yarn guide tube 38.

Accordingly, the sucking force by the jetted air stream in FIGS. 1, 2 reaches the top end of the yarn guide tube 51. When an operator grips the yarn Y taken out from the yarn supply bobbin 14 and brings it to the top end of the yarn guide 50 in this state, the yarn Y is sucked in the yarn guide hole 51 of the yarn guide tube 38, and the yarn Y passes through the central hole 52 of the stationary disc 9 and is guided from the yarn guide hole 19 of the spindle 4 to the yarn guide tube 18 of the yarn store disc 6 through the inclined hole 53. Since an air stream flowing in the radial direction is present in the yarn guide tube 18, the yarn which has arrived at the yarn guide tube 18 is discharged outside the yarn guide tube 18 by this air stream, passed through the space 54 between the rotary disc 7 and the outer ring 11 along the air stream and allowed to rise in the space 55 between the outer cylinder 9*a* of the stationary disc 9 and the balloon restricting cylinder 13 arrive at the top end 13*a* of the balloon restricting cylinder 13. The yarn which has arrived at the top end 13*a* of the cylinder 13 is gripped by the operator and wound on a winding bobbin. Thus, the yarn passing operation is completed.

When the valve changeover switch is put off after completion of the yarn passing operation, supply of compressed air into the cylinder 25 is stopped and the piston 26 is brought down and returned to the original position by the force of the spring 30. Accordingly, the joint 28 is disengaged from the lower end of the spindle 4. When the hand is separated from the yarn guide 50 above the tension device 16, the yarn guide tube 38 is raised up by the force of the spring 42 and the normal state indicated by a solid line in FIG. 4 is restored. Accordingly, the ball tensor 45 in the tension device 16 is returned to the position indicated by a solid line from the position indicated by a chain line, and rotation of the spindle becomes possible. When the running belt 17 is then pressed to the wharve 5, normal winding is started again.

As will be apparent from the foregoing illustration, in the present device, only by a simple operation of pushing down the yarn guide tube 38, the tensor can be assuredly separated from the central axial line of the opening of the yarn contact guide and the yarn passing operation can be performed very smoothly. Furthermore, since the central axial line of the yarn guide tube 38 having the inclined portion is made in agreement with the central axial line of the opening of the yarn contact guide, even if the yarn guide tube 38 is rotated and the position of the top end of the inclined portion of the yarn guide tube 38 is deviated, the tensor can be assuredly separated from the central axial line of the opening of the yarn contact guide.

Figure 5:
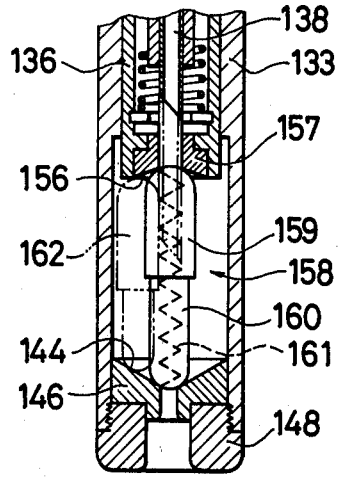
FIG. 5 is a partial view in section showing another embodiment of the tension device.

Other embodiments of the tension device 16 will be described. FIG. 5 shows a second embodiment of the tensor displacement device. A lower yarn contact guide 146 having an upwardly expanded conical face 144 is fixed to the nut 148 screwed and fixed to the lower end of the lower housing 133, and an upper yarn contact guide 157 having a downwardly expanded conical face 156 is fixed to the lower end of the upper housing 136. A capsule-shaped tensor 158 comprises upper and lower caps 159 and 160 slidably fitted to each other, and the upper and lower caps 159 and 160 are urged in directions separating from each other by a spring 161 built in the tensor, so that the semi-spherical top end portion (which may have a conical shape) of the upper cap 159 is normally located on the central axial line of the opening of the upper yarn contact guide 157 having the downwardly expanded conical face 156 and the semi-spherical lower end portion (which may have a conical shape) of the lower cap 160 is normally located on the central axial line of the opening of the lower yarn contact guide 146 having an upwardly expanded conical face 144. When the yarn guide tube 138 is brought down against the spring 42 shown in FIG. 4, the capsule-shaped tensor is separated from the central axial line along the downwardly expanded and upwardly expanded conical faces 156 and 114 of the upper and lower yarn contact guides 146 and 157. In short, the tensor displacement device according to the embodiment shown in FIG. 5 comprises upper and lower yarn contact guides 146 and 157, upper and lower caps 159 and 160 and a spring 161.

In the second embodiment, when the yarn guide tube 138 is pushed down against the spring 42 and the top end of the yarn guide tube 138 is brought down to a position indicated by a chain line, the capsule-shaped tensor including the upper and lower caps 159 and 160 and the spring 161 disposed therein is displaced from the central axial line of the openings of the upper and lower yarn contact guides 146 and 157 to the position 162 indicated by a chain line along the conical contact faces of the upper and lower yarn contact guides 146 and 157. Then the lower end of the yarn guide tube 138 intrudes into the central hole of the yarn contact guide and sucking force by the sucked air stream is transmitted and applied to the yarn end.

Figure 7:
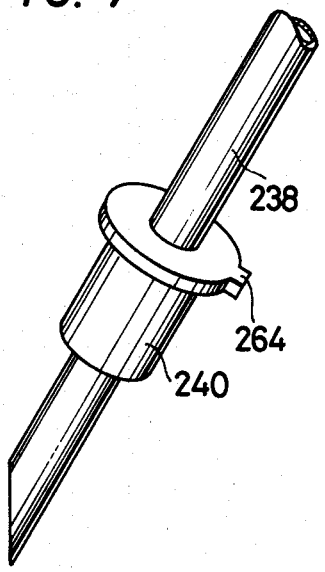
FIG. 7 is a perspective view showing another embodiment of a yarn guide tube with a flange.
Figure 8:
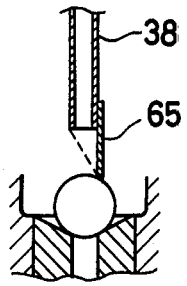
FIG. 8 is a partial view in section showing another embodiment of a lower end portion of the yarn guide tube.
Figure 6:
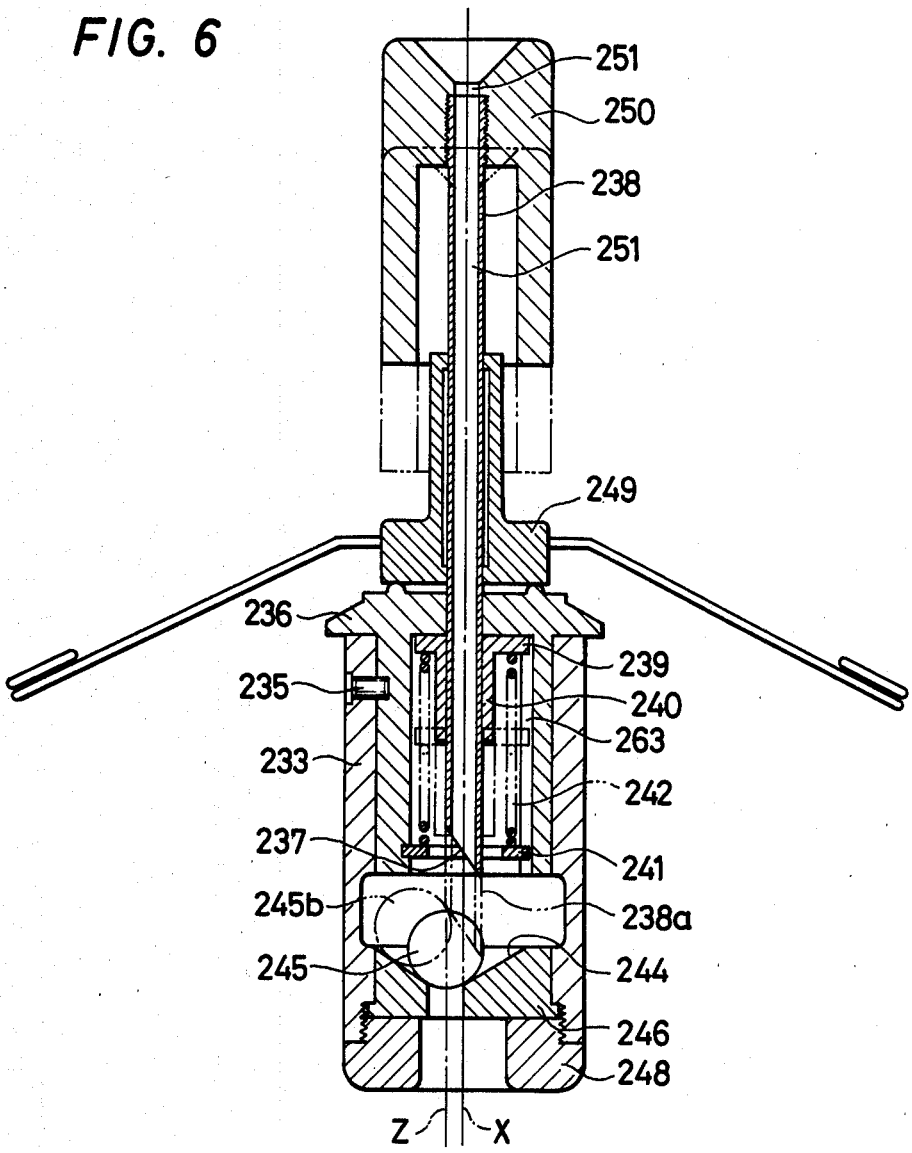
FIG. 6 is a longitudinally sectional view of showing still another embodiment of a tension device.

FIG. 6 is a longitudinally sectional view illustrating a third embodiment of the tensor displacement device. A housing comprises upper and lower housings 236 and 233 fixed to each other by a pin 235. A spring receiving groove is formed on the inner face of the upper housing 236 in the vicinity of the lower end thereof, and a turning-stopping groove 263 is formed to extend from the top end of the inner face of the housing 236 in the axial direction to the lower end of the inner face of the housing 236. A fixed ring 241 is fitted and fixed to the spring receiving groove so that a flanged guide ring 240 fixed integrally to a yarn guide tube 238 having a yarn passing hole 251 is normally pressed in one direction through a spring 242. A turning stopper 264 slidably fitted to the turning-stopping groove 263 formed in the upper housing 236 is formed on one end of the periphery of the flange 239 of the flanged guide ring 240. (As shown in FIG. 7.) An abrasion-resistant yarn contact guide 246 is fixed onto a nut 248 screwed and fixed to the lower end of the lower housing 233, and the yarn contact guide 246 is opened so that the axial line of the center of the opening of the yarn contact guide 246 is deflected from the central axial line X of a yarn guide tube 238 having an inclined portion on the top end thereof and the center of the opening of the yarn contact guide 246 is located at the position confronting the inclined face formed on the top end of the yarn guide tube 238. A spherical tensor 245 is normally located on the central axis line Z of the opening of the yarn contact guide 246 and is arranged so that when the yarn guide tube 238 is pushed down against the spring 242, the tensor 245 is separated from said central axial line along the upwardly expanded conical face 244 on the top face of the yarn contact guide 246. A flyer boss 249 is rotatably inserted into the yarn guide tube 238 and placed in this state on the upper housing. A yarn guide 250 is screwed to the top end of the yarn guide tube 238 so as to perform the yarn passing operation smoothly. In the foregoing embodiment, the spherical tensor is disposed. Needless to say, a tensor comprising upper and lower cylindrical caps fitted to each other and a spring disposed in the interior thereof may be used instead of the above-mentioned spherical tensor. Also in this case, the same function can be exerted.

In the other embodiments, the lower end of the yarn guide tube 38 may be constructed by fixing a plate 65 in spite of forming the inclined guide face 37. (Shown in FIG. 8).

The operation of the present device will now be described.

While the rotation of the spindle 4 is stopped, the top end of the yarn Y taken out from a yarn supply bobbin 14 is guided to the yarn guide hole 251 on the top end of the tensor device 16, and the yarn guide tube 238 fixed integrally to the flanged guide ring 239 is brought down to the position 238*a* against the spring 242 as indicated by a chain line to push the inclined top end portion 237 of the yarn guide tube 238 between the tensor 245 and the upwardly expanded conical face 244 on the top face of the yarn contact guide 246. As a result, the tensor 245 is displaced from the central axial line of the opening of the yarn contact guide 246 along the upwardly expanded conical face 244 as indicated by a chain line.

When the yarn guiding operation is completed, the supply valve 24 is taken out and the yarn guide tube 238 is released. As a result, by the restoring force of the spring 242, the yarn guide tube 238 is returned to the position indicated by a solid line in FIG. 6, and also the tensor 245 is automatically returned to the central position of the opening along the upwardly expanded conical face on the top face of the yarn contact guide 246 and a tension is given to the yarn Y by the tensor 245.

As will be apparent from the foregoing illustration, in the present device, only by a simple operation of pushing down the yarn guide tube 238, the tensor 245 can be assuredly separated from the central axial line of the opening of the yarn contact guide 246. Furthermore, since the center of the opening of the yarn contact guide 246 is deflected from the central axial line of the opening of the yarn guide tube 238 and the inclined portion is formed on the yarn guide 238, the tensor 245 can be separated from the central axial line of the opening of the yarn guide tube 238 very smoothly.

As will be apparent from the foregoing illustration, according to the present invention, a yarn passage is formed by the yarn guide tube 38 vertically movably inserted in the tension device 16 inserted in the center of a yarn supply bobbin, the yarn guide hole 19 formed in the center of the stationary disc 9 through the center of the spindle, which has the top end opened to the top end of the spindle and the lower end communicated with the yarn guide tube 18 of the yarn store disc 6, the yarn guide tube 18 formed in the radial direction of the yarn store disc 6, the yarn passing space 54 formed between the rotary disc 7 fixed to the spindle 4 and the outer ring 11, and the vertical space 55 between the outer cylinder 9*a* of the stationary disc 9 and the balloon restricting cylinder 13, wherein the jet hole 22 of the air guide hole 21 of the spindle, which has an opening 20 on the lower end of the spindle, is opened at 22*a* on the inclined face 53*a* formed in the communication portion between the yarn guide hole 19 of the spindle 4 and the yarn guide tube 18 mounted on the yarn store disc 6 so that air is jetted toward the outlet 23 of the yarn guide tube 18 and the vertically movable valve 24 having the compressed air supply fine tube is arranged just below the air guide hole 21 opened at 20 on the lower end of the spindle. By virtue of this specific structure, when the spindle is stopped at the time of yarn breakage or yarn exchange, compressed air can be supplied to the air guide hole 21 at the center of the spindle irrespectively of the stop position of the spindle. More specifically, only by raising up the piston 26 for supply of compressed air, which is located just below the opening 20 of the air guide hole on the lower end of the spindle, the compressed air supply valve 24 can be communicated with the air guide hole 21 of the spindle 4.

Furthermore, since compressed air supplied to the air guide hole 21 of the spindle is jetted into the yarn guide tube 18 of the yarn store disc 6 through the center of the spindle, the sucking force is caused to act on the tension device 16 and the yarn guide hole 19 of the spindle. Since the tensor displacing means is provided with the tension device 16, only by bringing the end of the yarn being supplied to the yarn guide 50 on the top end of the tension device, the yarn end is passed through the yarn guide hole 51 and is discharged into the yarn guide tube 18 of the yarn store disc 6 through the inclined hole 53 of the spindle 4. The yarn taken out from the yarn guide tube 18 is transferred along the rising air stream flowing between the outer ring 11 and rotary disc 7 and the rising air stream flowing between the outer cylinder 9*a* of the stationary disc 9 and the balloon restricting cylinder 13 and is delivered above the balloon restricting cylinder 13. Accordingly, the yarn passing operation can be accomplished very easily.

What is claimed is:

1. In a textile yarn processing machine, such as a two-for-one twister or the like, having a spindle assembly including a driven rotor mechanism defining a vertically extending yarn passageway and a horizontally extending passageway mating with said vertically extending passageway, a carrier means for carrying a hollow package of yarn and rotatably mounted on said rotor mechanism so that said rotor mechanism may rotate relative thereto, said carrier means including a basket device surrounding the package of yarn carried thereby so that yarn withdrawn from the package can form a balloon over said basket device as it passes from said rotor mechanism, a balloon limitor device surrounding said basket device so that the yarn balloon will pass between said basket device and said balloon limitor device in a generally upward vertical path of travel, air operated threading mechanism for automatically threading yarn pulled from said package through said passageways of said rotor mechanism, said threading mechanism comprising means for supplying air under pressure through said passageway so that yarn pulled from said package will be pulled downward through said vertically extending passageway and outwardly through said horizontally extending passageway; the improvement comprising tension means disposed toward the upper part of said vertical passageway, and an inclined surface means disposed in the vicinity of said mating of said vertical and said horizontal passageways, said inclined surface means having an air outlet provided at about the center or lower portion of said inclined surface so that yarn passing from the vertical passageway to the horizontal passageway will be acted upon by air passed through said air hole at substantially the turning point of the yarn from vertical to horizontal positions, whereby during threading operation said tension means is moved from the threading path of said yarn and cooperatively said air is supplied through said air hole of said inclined surface, thereby to produce a smooth and uninterrupted threading of said yarn, wherein said tension means comprises a guide tube having an inclined portion on the lower end thereof and a collar, said guide tube being inserted and fitted in said spindle assembly, and wherein said tension means further comprises a tensor and a yarn contact guide so that the central axial line of said yarn guide tube coincides with the central axial line of an opening of said yarn contact guide, and is normally urged upward by a spring winding around said collar, whereby the inclined portion of said yarn guide tube falls in contact with said tensor to displace the tensor from the central axial line of the opening of said yarn contact guide when the yarn guide tube is brought down against said spring.

2. The invention of claim 1, wherein said tensor has a spherical shape.

3. The invention of claim 1, wherein said tensor is a capsule shaped member, comprising upper and lower caps slidably fitted to each other and a spring interposed between said upper and lower caps.

4. The invention of claim 1, wherein said yarn guide tube comprises a turning stopper slidably fitted to a turning stopping groove formed in said spindle assembly, on the periphery of said collar, said tube being inserted and fitted in said spindle assembly and wherein said contact guide has a deflected opening so that the central axial line of said yarn guide tube is deflected from the central axial line of the opening of said yarn contact guide.

5. The invention of claim 4, wherein said contact guide is so arranged that the center of the opening of the contact guide is located at a position confronting said inclined portion.

6. The invention of claim 4, wherein said tensor has a spherical shape.

* * * * *